United States Patent [19]

Westphal

[11] 4,363,404

[45] Dec. 14, 1982

[54] END CLOSURE FOR STACKABLE FROZEN FOOD CONTAINERS

[75] Inventor: Teddy M. Westphal, Glencoe, Mo.

[73] Assignee: Boise Cascade Corporation, Boise, Id.

[21] Appl. No.: 248,901

[22] Filed: Mar. 30, 1981

[51] Int. Cl.[3] ..... B65D 21/02; B65D 3/14

[52] U.S. Cl. ..... 206/508; 206/509; 220/66; 229/55; 229/56

[58] Field of Search ..... 206/508, 509; 229/5.5, 229/5.6, 5.8; 220/66

[56] References Cited

U.S. PATENT DOCUMENTS

| | | | |
|---|---|---|---|
| 2,012,213 | 8/1935 | Young | 220/66 |
| 2,290,749 | 7/1942 | Hildebrandt | 229/5.8 |
| 2,350,312 | 5/1944 | Hatch | 229/5.8 |
| 3,288,342 | 11/1966 | Tinker | 229/5.6 |
| 3,409,167 | 11/1968 | Blanchard | 220/66 |
| 3,429,475 | 2/1969 | Scholtz | 206/508 |
| 3,492,773 | 2/1970 | Bergstrom | 220/66 |
| 3,933,298 | 1/1976 | Elderbrock | 229/5.6 |
| 3,954,178 | 5/1976 | Mason | 206/508 |
| 4,051,954 | 10/1977 | Smith | 229/5.5 |

*Primary Examiner*—George E. Lowrance

*Attorney, Agent, or Firm*—Laubscher, Philpitt & Laubscher

[57] ABSTRACT

An end closure member is disclosed for closing the bottom of an institutional-size composite container for frozen liquid or fluent materials (such as eggs removed from the shell), characterized in that the end closure member includes a center panel portion, an annular rim portion, and a vertical intermediate tubular portion that connects the center panel portion with, and at a lower elevation than, the rim portion, whereby during the subsequent freezing of the product within the container, the freezing progresses upwardly from the central panel portion, thereby relieving stress on the connection between the bottom end member and the composite body wall. The bottom end closure member includes a stacking rib adapted for insertion within a corresponding stacking recess contained within the container upper closure member.

6 Claims, 4 Drawing Figures

END CLOSURE FOR STACKABLE FROZEN FOOD CONTAINERS

BRIEF DESCRIPTION OF THE PRIOR ART

Composite containers including fibrous body walls are, of course, well known in the patented prior art as illustrated, for example, by the inventor's prior U.S. Pat. Nos. 3,724,709, 3,961,566, and 4,216,736, the early Freinup et al. U.S. Pat. Nos. 2,793,126, 2,793,127 and 3,712,534, and the Ellerbrock U.S. Pat. Nos. 3,381,594, 3,397,809, 3,882,763 and 4,016,311, among others.

Moreover, composite containers for frozen products are known in the art (as taught, for example, by the Horning et al. U.S. Pat. No. 2,874,888), and metal ends for stackable containers are disclosed in the patents to Webster et al. U.S. Pat. No. 3,642,169 and Gonibas U.S. Pat. No. 4,199,073, among others.

During the rather recent development of institutional-sized (i.e. 9 14/16 inch diameter by 12 10/16 inch height) composite containers, the composite can was designed to be a substitute for the existing all-metal (tinplate steel) container. The bottom end and slip cover top of the composite can were copied from the metal container. Slight modifications were made to accommodate the thicker composite body wall, but the basic design and material remained the same as the all-metal can.

Early experience with the new composite 30# can in commercial filling and freezing operations revealed a problem with the design of the composite can. The bottom ends on a number of the composite cans were bulged and some were pushed off the can body during the freezing of the product in the can. It was found that during the freezing of the product it is very important to have good air flow around the container to allow heat transfer from the bottom end of the can. If the bottom end is insulated, the product will freeze at the top of the container first and the expansion of the product freezing against the bottom will bulge the end and in many instances force the end off of the container. This situation is more critical with the composite can than it is with the all-metal can because of the insulating effect of the paper side wall of the composite can. The side wall of the all-metal can helps to transfer heat out of the product while the composite body wall acts as an insulating medium which makes the need for air flow to the bottom surface of the can more critical than it is with an all-metal can. The air flow to the surface of the bottom end of the container can be accomplished by stacking the individual cans on racks or slats to separate the cans. Many of the customer packing operations do not use these devices because this requires the pallets to be restacked after the initial blast freeze on different pallets without the separators.

A second problem that was identified with the initial composite can design was that the cans did not have a stacking feature. The composite cans, when stacked on top of each other, were unstable and could be slid apart, or a stack would fall over easily.

SUMMARY OF THE INVENTION

The present invention was developed to provide an institutional-size bottom end profile (known as 914–#4 profile) for the composite container that has sufficient surface area exposed to the atmosphere, even if the container is placed on a continuous smooth surface such as a plywood sheet, corrugated paper board, or cardboard separator sheets, whereby heat transfer will result such that the freezing of the product inside the container will be promoted from the bottom end first. As a result of the extension of the bottom end profile beyond the double seam of the end, it was further designed into the end a stacking feature to interlock with the profile of the slip cover used on the top of this container.

Accordingly, a primary object of the present invention is to provide a bottom end closure member for composite frozen food containers, including a center panel portion, an annular rim portion adapted for connection with the bottom edge of a composite tubular body wall, and a generally vertical intermediate wall connecting the rim portion with the peripheral edge of, and at a higher elevation than, the center panel portion, whereby the central part of the bottom closure member extends downwardly below the lower edge of the composite body wall. Consequently, when the container is provided with a fluent material (such as egg yolks and whites removed from the shell) and is subject to a freezing temperature, the freezing will progress upwardly from the center panel of the bottom closure member.

According to another feature of the invention, the center portion of the bottom end closure member is provided with an annular stacking rib for cooperation with a corresponding stacking recess contained in the top closure member of a corresponding container, thereby to permit stacking of the containers in vertically aligned relation. While normally the height of the intermediate portion of the bottom end closure member is such that the corresponding rim portions of the contiguous end closure members of superimposed containers are in engagement, the height may be such as to establish a slight space between the rim portions between the bottom and top closure members of stacked containers, thereby to permit the flow of cooling medium to the central portion of the bottom end closure member.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 1:
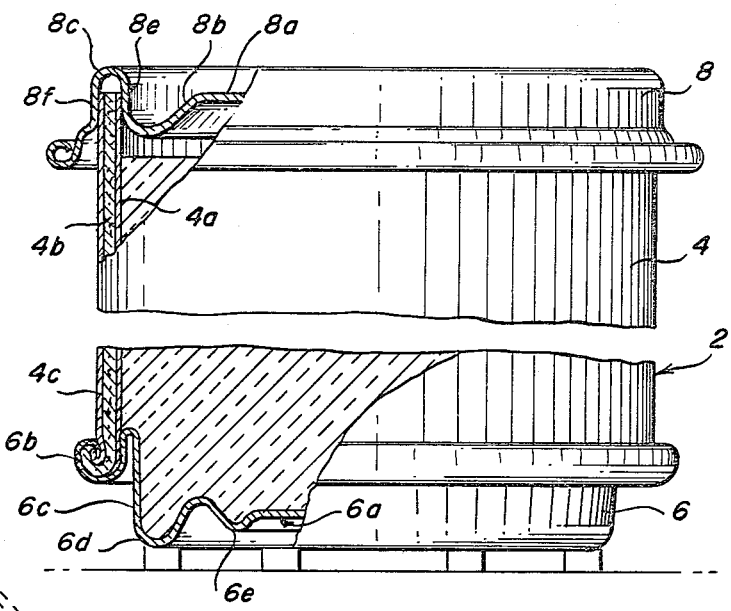
FIG. 1 is a partly sectioned side elevational view of the composite container for frozen foods and the like, in accordance with the present invention.

Referring first to FIG. 1, the composite container 2 of the present invention includes a tubular composite body wall 4, a bottom closure member 6, and a slip cover top or closure member 8. As is known in the art, the body wall 4 includes, in spirally wound layers, an inner liner layer **4*a* (formed, for example, of aluminum foil or polycoated paper), a fibrous body wall layer 4*b* (formed, for example, of paperboard), and an outer label layer 4*c* (formed of foil, paper or synthetic plastic material). The end closure members 6 and 8** may be formed of a rigid material, such as metal (aluminum, tinplate, coated tin-free steel, or the like), or a suitable conventional synthetic plastic material, such as polyethylene.

Figure 2:
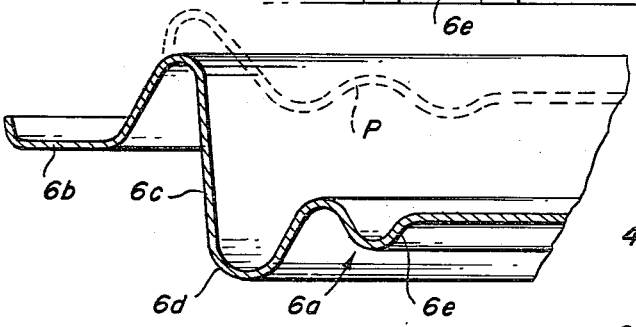
FIG. 2 is a detailed sectional view of the blank from which the end closure member of the present invention is formed.

In accordance with a characterizing feature of the present invention, the bottom end closure member 6 includes a circular horizontal center panel portion 6*a*, an annular rim portion 6*b*, and a generally vertical tubular intermediate portion 6*c* connecting the rim portion 6*b* with the peripheral edge of, and at a higher elevation than, the center panel portion 6*a*. As shown in greater detail in FIG. 3, the bottom end closure member is connected with the bottom edge portion of the composite body wall by a conventional double locked roller seam connection. As shown in FIG. 2, the stamped blank from which the end closure member is formed has a configuration that differs from that of the conventional metal end closure blank shown by the phantom outline P, in that the rim portion of 6*a* is vertically off-set from the center panel portion 6*c* by the vertical tubular intermediate portion 6*c*. Thus, the center panel portion 6*a* is arranged in concentrically spaced relation within the vertical intermediate wall and is connected in vertically spaced relation relative to the lower edge thereof, thereby to define a downwardly depending annular stacking rib 6*d*, as will be discussed in greater detail below. The central panel portion further includes conventional annular strengthening ribs 6*e*.

The upper end cover or closure member 8 is of slip fit construction for removable connection with the upper edge portion of the composite body wall 4, which closure member includes a circular central panel portion 8*a*, containing adjacent its outer periphery a stacking recess 8*b*, and an annular rim portion 8*c* containing a downwardly directed recess 8*d* defined between concentrically spaced inner and outer tubular portions 8*e* and 8*f* that are spaced to receive therebetween with a relatively tight friction fit the upper edge portion of the composite body wall 4.

In use, the bottom closure member 6 is connected with the lower edge of the composite body wall 4 by the illustrated roller seam connection, whereupon the product to be frozen (such as eggs removed from the shell, for example) is introduced into the container. Preferably, the cover member 8 is then fitted downwardly to close the upper end of the container, whereupon the container package is positioned on a fixed open horizontal support surface (such as a pallet, a grate, a mesh screen or the like) and is subjected for a given period of time to a subfreezing temperature, thereby to freeze the product within the container. Owing to the unique configuration of the bottom end closure member (which causes the central portion thereof to extend downwardly beyond the lower edge of the composite body wall), freezing of the packaged product processes upwardly from the central panel portion 6*c*, thus reducing the stress that is applied to the rolled seam connection between the end closure rim portion 6*b* and the lower edge portion of the body wall.

If desired, it is possible in certain cases to apply the cover member 8 to the container after the container contents have been frozen to their solid condition.

Figure 3:
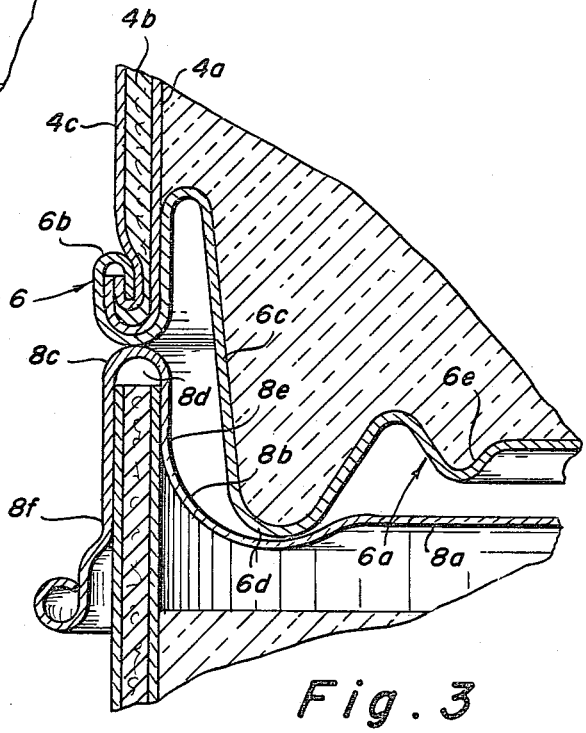
FIG. 3 is a detailed sectional view illustrating the stacking feature afforded by the containers of FIG. 1.

The containers of FIG. 1—with their contents in the frozen solid condition—may then be stacked as shown in FIG. 3, the stacking ribs 6*d* of the upper containers extending downwardly into the stacking recesses 8*b* contained in the top closure member 8. The inner annular wall of the stacking recess 8*b* is slightly inclined to the vertical to provide the desired centering reaction between the stacked containers.

Figure 4:
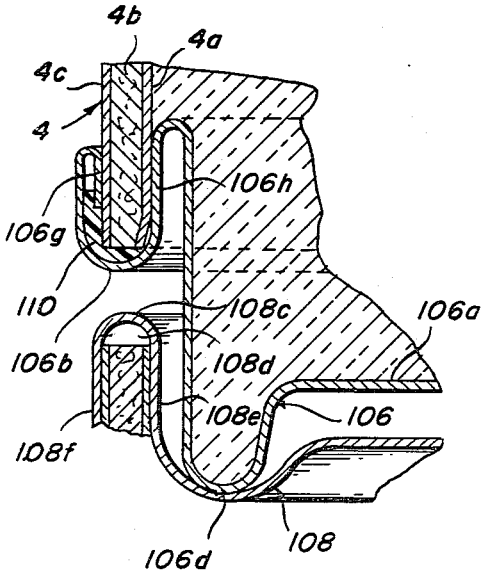
FIG. 4 is a detailed sectional view of another embodiment of the connection between the bottom end closure member and the composite body wall.

Referring now to the embodiment of FIG. 4, the rim portion 106*b* of the bottom end closure member 106 contains an upwardly directed trough defined between the reversely bent terminal portion 106*g* and the spaced vertical trough wall portion 106*h*. The spacing distance between the trough wall portions is such as to produce a forced fit when the lower edge portion of the composite body wall is inserted downwardly within the trough. Preferably, a layer 110 of conventional wax-like hot melt material is introduced in the trough as the lower edge of the body wall 4 is introduced into the trough. Alternatively, a layer of conventional adhesive material may be provided for bonding the bottom end closure to the lower edge portion of the composite body wall. As in the embodiment of FIG. 1, since the central portion of the bottom closure member extends below the lower edge of the composite body wall 4, the freezing of a product within the container progresses upwardly from the central panel portion 106*g*, thereby relieving the stress that would otherwise be applied to the force fit connection owing to the expansion of the product during freezing.

It is to be noted that in the embodiment of FIG. 4, the height of the intermediate portion 106*c* is such as to maintain a slight spacing distance between the rim portions 106*b* and 108*c* of the stacked containers, thereby to permit the access of cooling medium to the center portion of the bottom end closure member.

While in accordance with the provisions of the Patent Statutes the preferred forms and embodiments of the invention have been illustrated and described, it will be apparent that changes and modifications may be made without deviating from the inventive concepts set forth above.

What is claimed is:

1. A container adapted for institutional use for containing frozen foods, comprising:

(a) a tubular composite body wall (4) including, in concentrically arranged relation, an inner liner layer, fibrous body wall layer, and an outer label layer;

(b) a rigid bottom closure member (6) including (1) a cylindrical generally vertical intermediate portion (6*c*);

(2) an annular rim portion (6*b*) connecting the upper end of said intermediate portion with the lower end of said body wall;

(3) a horizontal circular disk-shaped central panel portion (6*a*) arranged in concentrically spaced relation within said intermediate portion; and (4) means connecting said central panel portion with the lower edge of said intermediate portion at a position having a higher elevation than that of the lower edge of the vertical intermediate portion and a lower elevation than that of said annular rim portion, said connecting means cooperating with said intermediate portion to define a downwardly extending annular stacking rib (6*d*); and (c) a rigid top closure member (8) closing the upper end of said composite body wall, said top closure member containing an annular recess (8*b*) for receiving the stacking rib of a second container stacked vertically thereon, whereby when the container is provided with a liquid or fluent material that is subjected to progressively decreasing temperature, freezing of the material proceeds upwardly in the container from the rib and central panel portions of the bottom closure member.

2. A composite container as defined in claim 1, wherein the annular rim portion of said bottom closure member is connected with the lower extremity of said body wall by a rolled seam.

3. A composite container as defined in claim 1, wherein the annular rim portion of said bottom closure member contains an annular trough for concentrically receiving the lower extremity of said composite body wall; and further including a layer of hardenable material (110) arranged in the trough for bonding said bottom closure member to said composite body wall.

4. A composite container as defined in claim 3, wherein said hardenable material comprises a hot melt.

5. A composite container as defined in claim 3, wherein said hardenable material comprises an adhesive.

6. A container adapted for institutional use for containing frozen foods, comprising:

(a) a tubular composite body wall (4) including, in concentrically arranged relation, an inner liner layer, fibrous body wall layer, and an outer label layer;

(b) a rigid bottom closure member (6) including (1) a cylindrical generally vertical intermediate portion (6*c*);

(2) an annular rim portion (6*b*) connecting the upper end of said intermediate portion with the lower end of said body wall;

(3) a horizontal circular disk-shaped central panel portion (6*a*) arranged in concentrically spaced relation within said intermediate portion; and (4) means connecting said central panel portion with the lower edge of said intermediate portion at a position having a higher elevation than that of the lower edge of the vertical intermediate portion and a lower elevation than that of said annular rim portion, said connecting means cooperating with said intermediate portion to define a downwardly extending annular stacking rib (6*d*); and (c) a rigid top closure member (8) closing the upper end of said composite body wall, said top closure member containing an annular recess (8*b*) for receiving the stacking rib of a second container stacked vertically thereon, (d) the height of said bottom closure member intermediate portion being such as to produce an annular space between the upper extremity of the rim portion of the top closure member of a first container and the rim portion of the bottom closure member of a second container stacked vertically thereon.

* * * * *